US005727315A

United States Patent [19]

Higuchi

[11] Patent Number: 5,727,315

[45] Date of Patent: Mar. 17, 1998

[54] RODLESS CYLINDER AND METHOD OF MANUFACTURING CYLINDER TUBE OF THE SAME

[75] Inventor: Yasuo Higuchi, Nagoya, Japan

[73] Assignee: Pubot Giken Co., Ltd., Aichi-gun, Japan

[21] Appl. No.: 617,559

[22] Filed: Mar. 19, 1996

[30] Foreign Application Priority Data

Mar. 23, 1995 [JP] Japan ..... 7-104523

[51] Int. Cl.[6] ..... B21D 9/00

[52] U.S. Cl. ..... 29/888.06; 72/369

[58] Field of Search ..... 29/888.06, 890.053; 72/367, 369, 370, 52

[56] References Cited

U.S. PATENT DOCUMENTS

| | | | |
|---|---|---|---|
| 5,094,096 | 3/1992 | Sheckells | 72/369 |
| 5,275,031 | 1/1994 | Whiteside et al. | 72/369 |
| 5,339,670 | 8/1994 | Granelli | 72/369 |
| 5,348,213 | 9/1994 | Randlett et al. | 29/890.053 |
| 5,388,329 | 2/1995 | Randlett et al. | 29/890.053 |

FOREIGN PATENT DOCUMENTS

| | | | |
|---|---|---|---|
| 3-258417 | 11/1991 | Japan | 72/369 |
| 783961 | 10/1957 | United Kingdom | 72/369 |

*Primary Examiner*—Erick R. Solis

*Attorney, Agent, or Firm*—Armstrong, Westerman, Hattori, McLeland & Naughton

[57] ABSTRACT

This rodless cylinder is a rodless cylinder of pneumatic driving slit type, and a cyliner tube is provied with a curved part bent in the axial direction, and a slit of nearly trapezoidal section is formed along the longituinal direction of the inner circumferential side of the curve, and a seal belt with both ends fixed within the cylinder tube is arranged to be fitted to the slit and a piston is inserted within the cylinder. The piston has a piston body and seal pistons connected rockable to both sides of the piston body, and the piston body is provied with a connecting part projecting from the slit to the outside and a belt inserting hole for insertion of the seal belt. On an outer circumferential part of the piston body and the seal pistons, an annular groove with a bottom being a part of a spherical surface is formed and a wear ring having an inner circumferential surface with the same curved surface is inserted slantwise within the annular groove. In the cylinder tube of the rodless cylinder, a slit is formed linearly in the longitudinal direction of the outer circumferential part of a linear tubular material by cutting, and while the spacer is fitted into the slit, the tubular material is set in a recess of of a movable die and a fixed die of a bending machine and the movable die is moved along the curved outer circumferential part of the fixed die thereby the tubular material is bent with the spacer at inside.

2 Claims, 4 Drawing Sheets

RODLESS CYLINDER AND METHOD OF MANUFACTURING CYLINDER TUBE OF THE SAME

BACKGROUND OF THE INVENTION

1. Field of the Invention

The present invention relates to a rodless cylinder of slit type driven by pneumatics, and more particularly to a rodless cylinder of slit type having a curved part in the axial direction and moving a piston along the curve and a method of manufacturing a cylinder tube thereof.

2. Description of the Prior Art

In the prior art, as rodless cylinders driven by pneumatics, a rodless cylinder of slit type and a rodless cylinder of magnet type are known. The rodless cylinder of slit type has structure that a connecting part is projected from a slit formed in a cylinder tube, and the rodless cylinder of magnet type has structure that a slit is not provided in a cylinder tube and a connecting part provided on the outside of the cylinder and a piston on the inside are connected and operated by magnetic force.

In recent years, in factory facilities, conveyance machines and so forth, there is request of curved motion of a body using a rodless cylinder. In such a place, in the prior art, a rodless cylinder of magnet type having a curved part has been used for driving the curved motion. In the rodless cylinder of magnet type, however, since a piston and a connecting part are connected through magnetic force, there is a problem that sufficient thrust can not be generated.

SUMMARY OF THE INVENTION

An object of the present invention is to provide a rodless cylinder of pneumatic driving slit type having a curved part and performing a curved motion of a piston where leakage of the pneumatic power is minimized and sufficient thrust can be generated, and to provide a method of manufacturing a cylinder tube which can form a slit in a cylinder tube having a curved part easily at high accuracy.

The rodless cylinder of the present invention is a rodless cylinder of pneumatic driving slit type where a cylinder tube is provided with a curved part bendable in the axial direction, and a slit with nearly trapezoidal section is formed along the longitudinal direction on the inner circumferential side of the curve, and a seal belt with nearly trapezoidal section arranged in fixing both ends within the cylinder tube can be fitted to the slit, thereby the piston is fitted and inserted within the cylindrical tube. The piston has a piston body and seal pistons connected rockable to both ends of the cylinder body through a shaft, and the piston body is provided with a projection connecting part projected from the slit to the outside and a belt inserting hole for insertion of the seal belt. Further an annular groove with a bottom surface being a part of a spherical surface is formed on the outer circumferential part of the piston body and the seal pistons, and a wear ring having an inner circumferential surface in the same curved surface as that of the spherical bottom surface is fitted slantwise into the annular groove.

Also a method of manufacturing a cylinder tube of a rodless cylinder of the present invention is characterized in that a slit is formed linearly in the longitudinal direction of an outer circumferential part of a linear tubular material by cutting work, and next in the state that a spacer is fitted into the slit, the tubular material is set within recess of a movable die and a fixed die of a bending machine, and the movable die is moved along the curved outer circumferential part of the fixed die thereby the tubular material is bent in the state that the spacer is disposed to the inside.

Thus since the cylinder tube is manufactured in that at first a slit is formed linearly in the longitudinal direction of an outer circumferential part of a linear tubular material by the cutting work, and next in the state that a spacer is fitted into the slit, the bending work is performed, while the accurate sectional dimension of the tubular material is held, the bending work can be performed thereby the curved cylinder tube having the slit and the inner circumferential part in the accurate sectional dimension can be manufactured.

Also even in the curved cylinder tube as above described, since the sectional shape of the slit is formed with high precision, during action of the piston, the seal belt is fitted to the slit closely and the slit is sealed well and the piston can be driven by sufficient thrust. Further since the piston is a connecting type piston where a piston body and a seal piston are connected, and an annular groove with a bottom surface being a part of a spherical surface is formed on the outer circumferential part of the piston body and the seal piston, and a wear ring having an inner circumferential surface with the same curved surface as that of the spherical bottom surface is formed slantwise within the annular groove, the reduction width of the outer diameter of the piston required for the piston to pass through the linear part and also the curved part can be made quite small thereby a gap between the inner surface of the cylinder and the outer circumferential surface of the piston is made minimum and the seal property is improved and the air leakage is made minimum and sufficient thrust can be generated.

DESCRIPTION OF THE PREFERRED EMBODIMENTS

Figure 1:
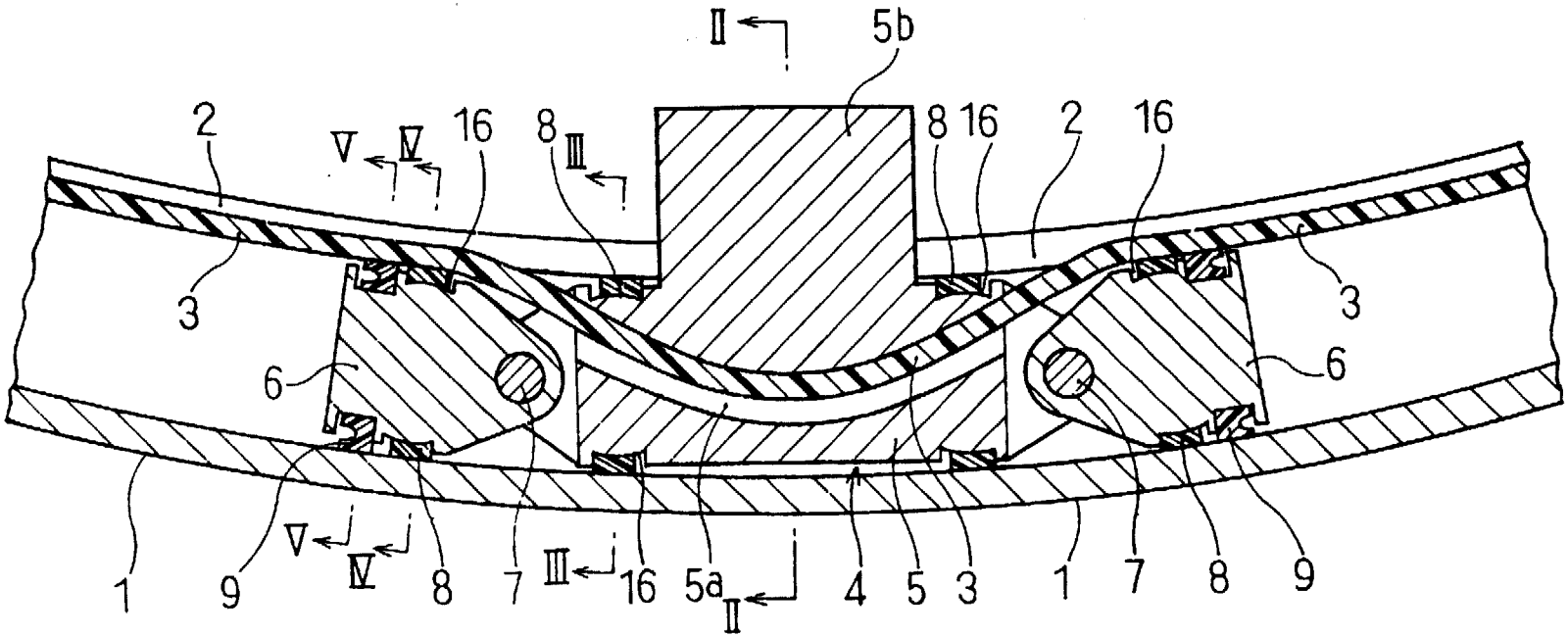
FIG. 1 is a sectional view of a rodless cylinder showing an embodiment of the invention.
Figure 2:
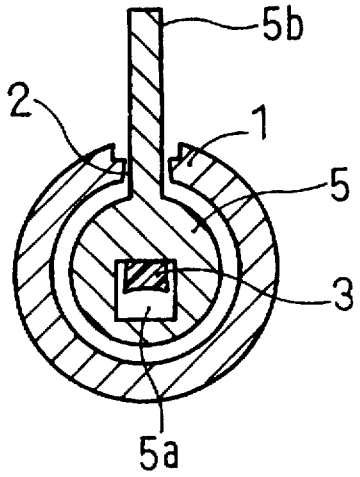
FIG. 2 is a sectional view taken on line II—II of FIG. 1.
Figure 3:
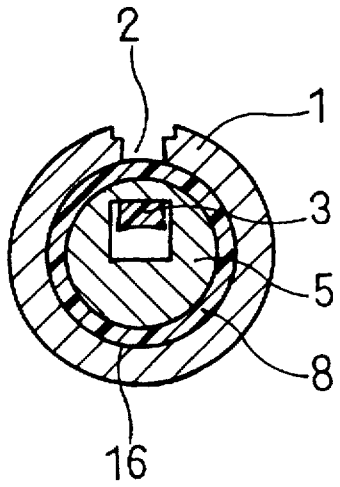
FIG. 3 is a sectional view taken on line III—III of FIG. 1.
Figure 5:
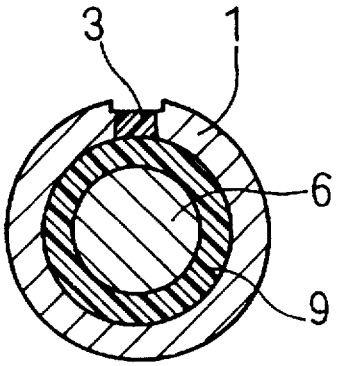
FIG. 5 is a sectional view taken on line V—V of FIG. 1.
Figure 4:
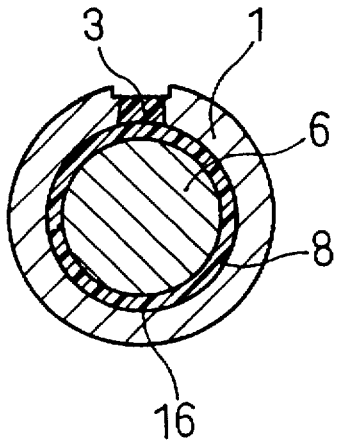
FIG. 4 is a sectional view taken on line IV—IV of FIG. 1.

An embodiment of the present invention will be described based on the accompanying drawings as follows. A cylinder tube 1 is formed in curved shape as shown in FIG. 1, and one slit 2 is formed in the axial direction (longitudinal direction) on the upper side of the cylinder tube 1, that is, on the inner circumferential side of the curved bent part. This slit 2 with its section shown in FIGS. 2 to 5, is formed in nearly trapezoidal sectional shape with the outer circumferential part being made the upper end (shorter side). Although not shown in the figures, both ends of the cylinder tube is closed by a head cover, and an air inlet port and an exhaust port are provided on the head cover.

The curved cylinder tube 1 is manufactured as follows. As a material, for example, a tubular material (STKM-13C) of outer diameter 35 mm and inner diameter 25 mm is used, and the linear tubular material is cut into prescribed length, and next using a cutting machine such as a milling machine, one slit having prescribed nearly trapezoidal section (slit having rectangular sectional part on trapezoidal sectional part) is formed linearly. In order to machine the slit to the linear tubular material, if a cutting machine such as a milling machine is used, the machine work can be performed relatively simply with high precision.

Figure 7:
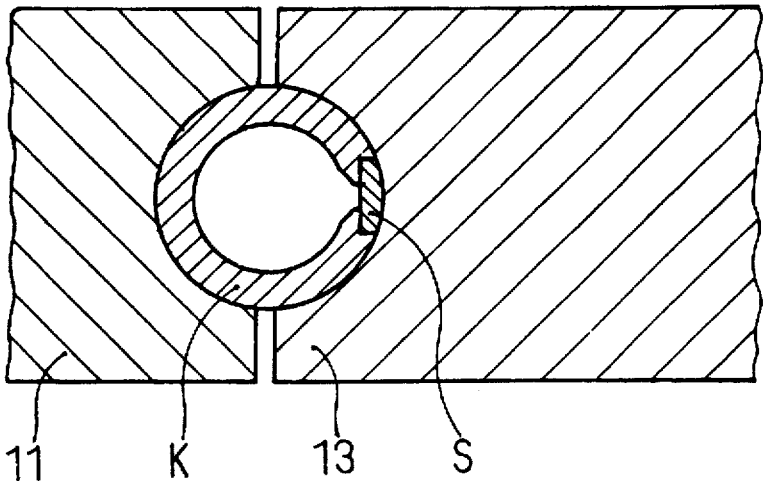
FIG. 7 is a sectional view taken on line VII—VII of FIG. 6.

Next, the tubular material with the slit formed thereon is laid on a bending machine for tubular material, and the bending work is applied so that bending shape with prescribed curvature can be obtained. During the bending work, to a rectangular sectional part of the slit of the tubular material K, a spacer S manufactured in the same width as that of the rectangular sectional part of the slit as shown in FIG. 7 is fitted, and the bending work is performed in the state that the spacer S is fitted. The spacer S is fitted throughout the overall length of the rectangular sectional part of the outer circumferential side of the slit.

Figure 6:
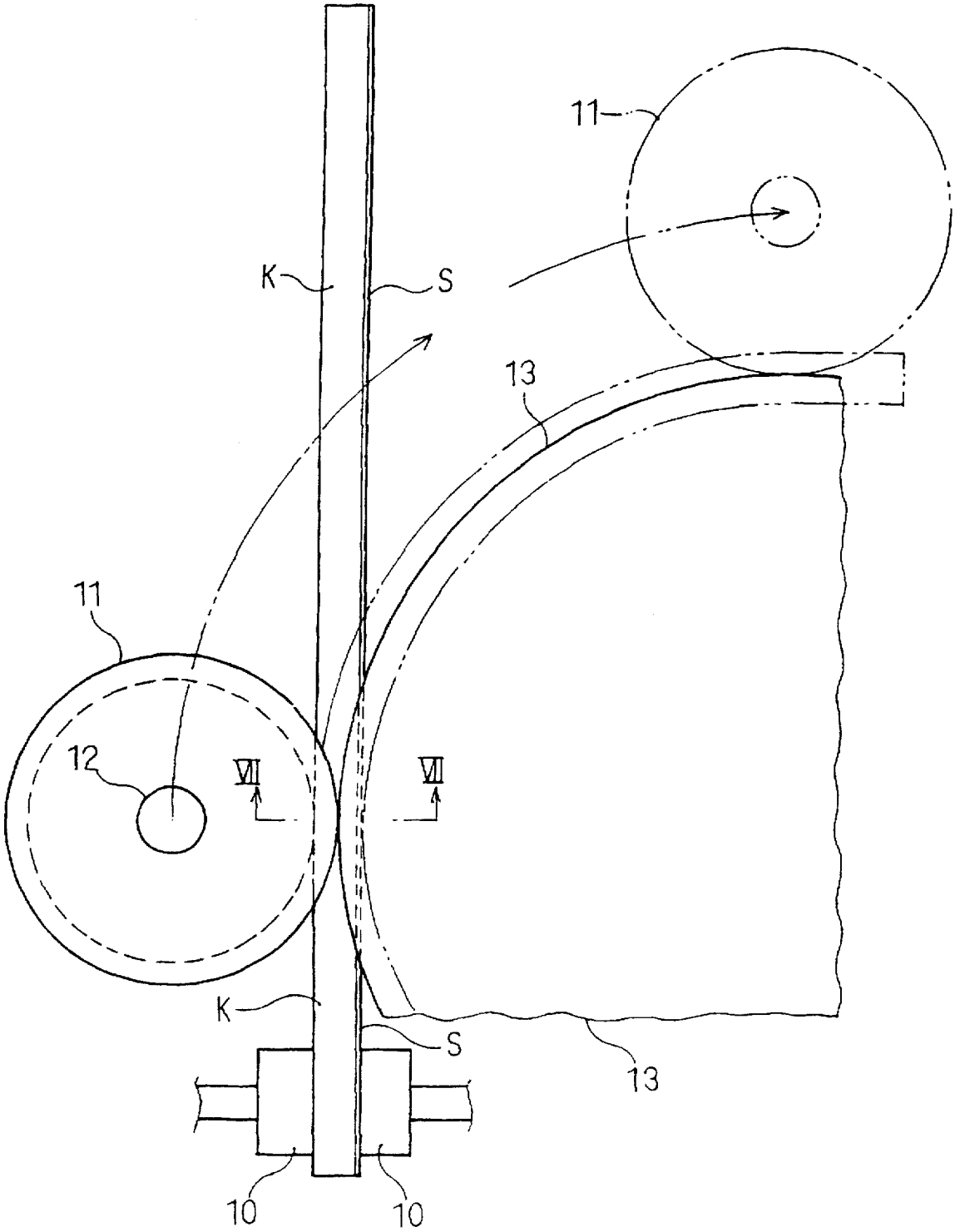
FIG. 6 is a schematic explanation diagram of a cylinder tube during bending work.

The bending machine is provided with a fixed die 13 and a movable die 11 as shown in FIG. 6, and a recess having semicircular section corresponding to the outer diameter shape of the tubular material K is formed on the outer circumferential part of the fixed die 13 and the movable die 11 and the recess of the fixed die 13 is provided with a curved part coinciding with the bending curvature of the cylinder tube 1. The movable die 11 is formed in disk shape and is supported rotatable by a shaft 12, and the shaft 12 is moved along the curved part of the fixed die 13 while the movable die 11 is rotated thereby the tubular material K is bent.

During the bending work, the tubular material K is inserted between the fixed die 13 and the movable die 11 of the bending machine in directing the slit side, i.e., the spacer S side to the fixed die side, and its end is set in clamping by a clamp 10. The movable die 11 is moved along the outer circumferential part of the fixed die 13 thereby the tubular material is bent along the fixed die 13 in the state that the spacer 3 is at the inside.

Then since the tubular material K is bent with the slit being at the inside and the spacer S is fitted to the slit, the bending work is performed in the state that the outer circumference of the tubular material is bound, that is, in the state that the sectional shape of the slit is held accurately. Also then since the spacer S is fitted to the stepped part on the outer circumferential side of the slit, that is, the rectangular sectional part, the spacer S does not deviate during the bending work, and the bending work is performed while the tubular material holds the accurate sectional dimension within the recess of the fixed die 13 and the movable die 11. Consequently the cylinder tube having the slit of the accurate sectional dimension can be manufactured.

Figure 8:
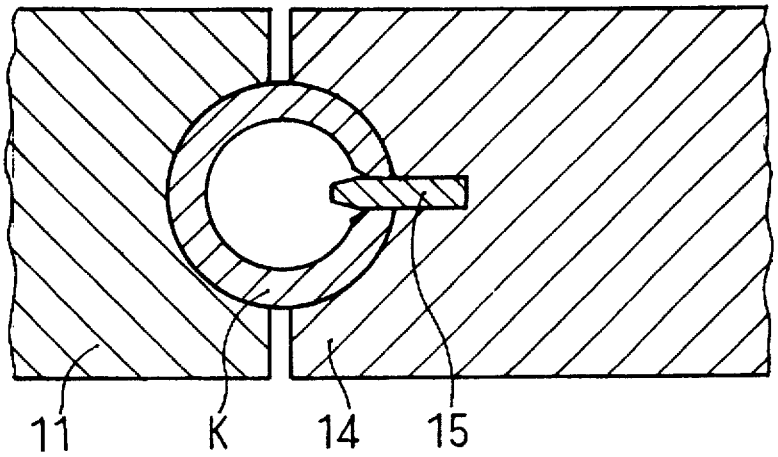
FIG. 8 is a sectional view during bending work in another embodiment.

FIG. 8 is a sectional view showing another embodiment of a bending machine. In this embodiment, a projection stripe part 15 corresponding to the spacer is projected with the outer circumference directed within the curved recess of the fixed die 14. When the tubular material K is bent, the tubular material K is inserted between a fixed die 14 and a movable die 11 of the bending machine and the projection stripe part 15 of the recess of the fixed die 14 is fitted to the slit and the end of the tubular material is set in clamping by a clamp 10.

In similar manner to the preceding embodiment, the movable die 11 is moved along the outer circumferential part of the fixed die 14, thereby while the projection stripe part 15 is fitted to the slit of the tubular material and the outer circumferential part of the tubular material is bound by the fixed die 14 and the movable die 11, the tubular material is bent along the curved part of the fixed die 14. In this embodiment of FIG. 8, since the projection stripe part 15 corresponding to the spacer is provided in the fixed die 14, whatever shape is the sectional shape of the slit, there is no fear that the spacer (projection stripe part) deviates from the slit during the bending work.

Thus in the inside of the cylinder tube 1 having the slit machined with high precision and having the curved part of prescribed curvature, the seal belt 3 is arranged to be fitted to the slit 2, and its both ends are fixed by a head cover part (not shown) on both ends of the cylinder tube. The seal belt 3 is made of synthetic resin with a reinforcement applied thereto so as to have suitable elasticity, flexibility and good sliding property, and has trapezoidal section which can be suitably adapted and fitted well to the sectional shape of the slit 2.

A piston 4 to be fitted within the cylinder tube 1 comprises a piston body 5 having a belt inserting hole **5*a* for insertion of the seal belt 3 and a connecting part 5*b* projected, and seal pistons 6, 6 connected to both sides of the piston body 5 through shafts 7, 7. The belt inserting hole 5*a* of the piston body 5 is formed in curved shape at the inside of the center and the seal belt 3 is inserted in the hole 5*a***.

On the outer circumferential part at the front and rear sides of the piston body 5 and the outer circumferential part of the seal pistons 6, 6, an annular groove 16 with a bottom surface being a part of a spherical surface is formed and a wear ring 8 having an inner circumferential surface of the same curved surface as that of the spherical bottom surface is inserted slantwise in the annular groove 16. That is, width of the annular groove 16 is formed slightly wider than that of the wear ring 8, and the wear ring 8 can be slanted in angle range of about 3° from the position orthogonal to the center axis of the piston body 5 or the seal pistons 6, 6. The wear ring 8 is made of synthetic resin such as fluororesin having little coefficient of friction and being excellent in wearproof property with a reinforcement added thereto and is formed in ring shape.

The shafts 7, 7 connecting the seal pistons 6, 6 are arranged orthogonal to the plane including the curved part of the cylinder tube 1, and the seal pistons 6, 6 are supported to the piston body 5 rockable in the bending direction of the cylinder tube 1 thereby the seal pistons 6, 6 can be bent along the curve of the cylinder tube 1. On the outer circumferential part at nearly the center of the seal pistons 6, 6, an annular groove 16 with a bottom surface being a part of a spherical surface in similar manner to the above is formed, and a wear ring 8 having an inner circumferential surface of the same curved surface as that of the spherical bottom surface is inserted slantwise in the annular groove 16 in similar manner to the above. Further, on the outer circumferential part at the front side of the seal pistons 6, 6, a piston cup 9 is arranged in fitted state to an outer circumferential groove.

The seal belt 3 inserted in the belt inserting hole **5*a* of the piston body 5 pushes the cylinder tube 1 within the slit 2 by the outer circumferential part of the seal pistons 6, 6 positioned at the front and rear sides of the piston 4 and the outer circumferential part of the wear ring 8 and the piston cup 9, and closes the slit 2 other than that the piston 4 positioned thereon by the seal belt 3. The inner circumferential surface of the cylinder tube 1 is sealed by the wear ring 8 and the piston cup 9**.

In the rodless cylinder in such configuration, a driven body is connected to the connecting part **5*b* projected from the slit 2, and if air pressure is supplied from an air inlet port (not shown), the air pressure is applied to the seal piston 6 of the piston 4 thereby the piston 4 is moved. Then the seal belt 3 within the tube at the air pressure application side is pushed into the slit 2 by the air pressure and seals there, and the wear ring 8 and the piston cup 9 on the outer circumference of the seal piston act so that the seal belt 3 going out of the belt inserting hole 5***a* is pushed into the slit 2, and while the piston 4 is moved, the seal property within the cylinder tube 1 at the pressure application side is secured.

Also the seal pistons 6, 6 at the front and rear sides of the piston 4 are rocked about the shaft 7 coinciding with the curvature of the cylinder tube 1, and the piston 4 can be moved smoothly within the curved cylinder tube 1. Also since the sectional shape of the slit 2 is formed with high precision even in the curved cylinder tube 1 as above described, the seal belt 3 is fitted to the slit closely and the slit 2 is sealed well and the piston 4 can be driven by sufficient thrust.

For example, when the curvature radius of the curved part of the cylinder tube is 450 mm, and the inner diameter of the cylinder is 25 mm, and the wear rings of fixed type are installed on both ends of the piston body at spacing of 48 mm, since the piston body is in linear shape, in order that the piston body passes through the linear part and the curved part of cylinder tube, the outer diameter of the piston body must be reduced less than the cylinder inner diameter 25 mm by about 0.25 mm.

This reduction width of about 0.25 mm becomes a gap produced between the outer circumferential surface of the piston body and the inner surface of the cylinder when the piston body 5 is moved in the linear part of the cylinder. In the case of the present invention, since the wear ring 8 on both ends of the piston body 5 can be slanted by prescribed angle from the position orthogonal to the center axis of the piston body 5, for example, when the wear ring 8 of 5 mm width is used, the outer diameter of the piston body 5 may be reduced less than the cylinder's inner diameter 25 mm by about 0.007 mm. Consequently, a gap produced between the outer circumferential surface of the piston body and the inner surface of the cylinder becomes about 0.007 mm when the piston body 5 is moved in the linear part, and it is understood that the seal property is improved significantly in comparison to the case of using the wear ring of fixed type.

Further in the seal pistons 6, 6, the center axis of the seal pistons 6, 6 must be slanted in angle range of about 3° in coinciding with the shaft 7 connecting between the seal pistons 6, 6 and the piston body 5. Clearance between the inner diameter of the cylinder and the outer diameter of the piston caused by this becomes about 0.25 mm in the case of dimension under above-mentioned condition. In the present invention, the clearance becomes about 0.007 mm also in this case, and the seal property is significantly improved in comparison to the case of using the wear ring of fixed type.

What is claimed is:

1. A method of manufacturing a cylinder tube of a rodless cylinder having a slit, comprising:

(a) forming a slit linearly in the longitudinal direction of an outer circumferential part of a linear tubular material by cutting; and (b) setting said tubular material within a recess of a movable die and a fixed die of a bending machine, fitting a spacer into said slit, and bending said tubular material with said spacer in the slit while said movable die is moved along the curved outer circumferential part of said fixed die.

2. A method of manufacturing a cylinder tube having a slit, comprising:

(a) forming a slit linearly in the longitudinal direction of an outer circumferential part of a linear tubular material by cutting; and (b) setting said tubular material within a recess of a movable die and a fixed die of a bending machine such that a projection part projected within the recess of said fixed die is fitted into said slit, and fitting said projection part into said slit and bending said tubular-material with said slit being in the inside while said movable die is moved along the outer circumferential part of said fixed die.

* * * * *